US007524038B2

(12) United States Patent
Takahashi

(10) Patent No.: US 7,524,038 B2
(45) Date of Patent: Apr. 28, 2009

(54) LIQUID-JET HEAD AND LIQUID-JET APPARATUS

(75) Inventor: Tomoaki Takahashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 497 days.

(21) Appl. No.: 11/364,011

(22) Filed: Mar. 1, 2006

(65) Prior Publication Data

US 2006/0209136 A1 Sep. 21, 2006

(30) Foreign Application Priority Data

Mar. 1, 2005 (JP) ..... 2005-056685
Mar. 4, 2005 (JP) ..... 2005-061314

(51) Int. Cl.
*B41J 2/045* (2006.01)
*B41J 2/16* (2006.01)

(52) U.S. Cl. ..... 347/68; 347/50

(58) Field of Classification Search ..... 347/68–72
See application file for complete search history.

(56) References Cited

U.S. PATENT DOCUMENTS 6,390,589 B1 * 5/2002 Imanaka et al. ..... 347/19
6,869,170 B2 * 3/2005 Shimada et al. ..... 347/68
2004/0051763 A1 * 3/2004 Matsubara et al. ..... 347/68
2005/0128255 A1 * 6/2005 Nakanishi ..... 347/68

FOREIGN PATENT DOCUMENTS

JP 2004-1431 A 1/2004
JP 2004-216581 A 8/2004

* cited by examiner

*Primary Examiner*—Stephen D Meier
*Assistant Examiner*—Geoffrey Mruk
(74) *Attorney, Agent, or Firm*—Sughrue Mion, PLLC

(57) ABSTRACT

An object of the present invention is to provide a liquid-jet head and a liquid-jet apparatus each capable of stabilizing liquid ejection characteristics in favorable states, and also capable of preventing destruction of a vibration plate. Disclosed is a liquid-jet head including a laminated electrode which is provided on the vibration plate outward of a region corresponding to the piezoelectric elements, and is electrically connected to the lower electrode. In the liquid-jet head, a stress relaxing layer is provided at least in regions corresponding to edge portions of the laminated electrode between the laminated electrode and the vibration plate, the stress relaxing layer being made of a material having a linear expansion coefficient greater than that of the vibration plate and less than that of the laminated electrode.

30 Claims, 10 Drawing Sheets

LIQUID-JET HEAD AND LIQUID-JET APPARATUS

BACKGROUND OF THE INVENTION

1. Field of the Invention

The present invention relates to a liquid-jet head and a liquid-jet apparatus, and particularly relates to an ink-jet recording head and an ink-jet recording device where: a part of each pressure generating chamber communicating with a nozzle orifice for ejecting ink droplets is formed of a vibration plate; a piezoelectric element is provided on a surface of the vibration plate; and the ink droplets are ejected by displacement of the piezoelectric element.

2. Background Art

There have been two types in practical use as an ink-jet recording head where: a part of each pressure generating chamber communicating with a nozzle orifice for ejecting ink droplets includes a vibration plate; and ink droplets are ejected through the nozzle orifice in a manner that a pressure is applied onto ink in the pressure generating chamber by causing a piezoelectric element to deform the vibration plate. One of these two types is a head using piezoelectric actuators of a longitudinal vibration mode in which the piezoelectric actuators are elongated and contracted in an axial direction of piezoelectric elements. Another one uses piezoelectric actuators of a flexure-vibration mode. In the case of the former type, it is possible to produce a head suitable for high-density printing since end faces of piezoelectric elements make contact with a vibration plate and a volume of each pressure generating chamber is changed, but on the other hand, there is a problem that manufacturing processes are complicated. In this type, a method of cutting and separating the piezoelectric elements into comb-teeth like shapes so as to correspond to arrangement pitches of nozzle orifices, is required. Moreover, an operation of positioning the cut and separated piezoelectric elements in order to attach them to the pressure generating chambers to fix them. Contrastively, in the case of the latter type, it is possible to have piezoelectric elements formed on a vibration plate in a relatively easy process, where a green sheet which is provided as a material for the piezoelectric elements is attached in accordance with shapes of pressure generating chambers, and is baked thereafter. However, there is a problem that a high-density arrangement is difficult because this type requires an area large enough to allow utilization of flexure vibrations.

For the purpose of resolving the above described disadvantage in the latter type of recording head, there is another type of recording head where piezoelectric elements are formed so as to be independent from each other in a manner corresponding respectively to pressure generating chambers. In this manner, the piezoelectric elements are formed by forming a uniform piezoelectric material layer on an entire surface of a vibration plate with a deposition technique, and then, through a lithography technique, piezoelectric material layer is cut and separated into shapes corresponding to the respective pressure generating chambers. According to this type, the process of attaching the piezoelectric elements to the vibration plate is not required. The piezoelectric elements can be formed in a high-density state by using the precise and convenient lithography technique, and also, there is an advantage that a thickness of the piezoelectric elements can be thinner and thereby a high-speed drive is possible.

However, in an ink-jet recording head where piezoelectric elements are thus arranged in a high-density state, there are following problems since one electrode (a common electrode) of each of the piezoelectric elements is provided to be shared by the plural piezoelectric elements. When a large number of the piezoelectric elements are simultaneously driven to eject a large amount of ink droplets, ink ejection characteristics are deteriorated because a voltage drop occurs and displacements of the piezoelectric elements comes to be unstable. Note that, particularly with respect to an electrode of a piezoelectric element formed of a thin film, the electrode has-a relatively high resistance value because the film is thin, and hence is more likely to bring about the aforementioned problem.

For the purpose of solving these problems, there is a technology where a resistance value of the common electrode is substantially reduced by providing a connection wiring layer in a region facing a vicinity of an edge portion of each piezoelectric element in a longitudinal direction of the piezoelectric element. The connection wiring layer is electrically connected to the common electrode of the piezoelectric elements (for example, refer to Japanese Patent Application publication No. 2004-1431).

In order to reduce the resistance value of the common electrode, the connection wiring layer is made of a material which has relatively high conductivity, for example, a metal material such as gold (Au) or Aluminum (Al). Additionally, the connection wiring layer is formed to have a thickness substantially equal to that of the vibration plate, for example, between 1 and 3 μm. On the other hand, in many cases, the vibration plate is made of a material which has relatively low conductivity. For example, in Patent Document 1, a vibration plate is disclosed which includes an elastic film made of silicon dioxide ($SIO_2$) formed by thermally oxidizing a passage-forming substrate which is a single crystal silicon substrate.

Additionally, as methods of manufacturing the connection wiring layer, general ones are a spattering method, and a method where a film is patterned through etching after it has been deposited through a vapor deposition technique. In order to obtain a film having good adhesion with an undercoat thereof, through the spattering method or through the evaporation deposition technique, it is necessary to perform deposition while heating the passage-forming substrate (the vibration plate) at a temperature of about 100 to 300° C. Furthermore, in the spattering method, the deposition proceeds while atoms collide with the passage-forming substrate (the vibration plate). Accordingly, even without heating the passage-forming substrate, a temperature of the passage-forming substrate (the vibration plate) comes to be 150 to 300° C.

Therefore, when the connection wiring layer is deposited with the spattering method or the like, there is a problem that a membrane stress remains on the vibration plate, due to a difference in amount of contraction between the vibration plate and the connection wiring layer at a cooling phase. That is, there is a problem that, as the membrane stress remains on the vibration plate, the vibration plate around a periphery of the connection wiring layer easily cracks if en external force is imposed. The external force is, for example, a pressure application when a head is assembled, or capping when the head is used.

Additionally, among ink-jet recording heads of this type, for example, there is one head having a configuration where a reservoir includes a communicating portion and a reservoir portion, and ink is supplied from this reservoir to each pressure generating chamber (for example, refer to Japanese Patent Application publication No. 2004-216581). The communicating portion is provided on a passage-forming substrate, and the reservoir portion is provided on a reservoir forming plate joined to the passage-forming substrate. Here, in the ink-jet recording head having this configuration, there is a case that ink (moisture) in the reservoir infiltrates from the interface between the passage-forming substrate and the reservoir forming plate, and when the ink reaches a connection wiring layer, a voltage is applied to the ink. Accordingly, electrolysis is operated on the ink, and gas and foreign substances are generated, whereby ejection of ink droplets becomes inferior. Furthermore, if the ink reaches a piezoelectric element, there is a possibility that the ink destroys the piezoelectric element. Moreover, particularly in the structure where the connection wiring layer is provided as described above, a problem of this kind is more likely to occur as a thickness of an adhering agent to join the reservoir forming substrate, comes to be relatively large.

Meanwhile, it is obvious that the abovementioned problems are involved not only in ink-jet recording heads which eject ink, but also are involved similarly in other liquid-jet recording heads which eject liquid droplets other than ink.

SUMMARY OF THE INVENTION

In consideration of the above described situations, an object of the present invention is to provide a liquid-jet head and a liquid-jet apparatus which are respectively capable of stabilizing liquid ejection characteristics in favorable states, and also capable of preventing destruction of a vibration plate. Additionally, another object of the present invention is to provide a liquid-jet head and a liquid-jet apparatus which are respectively capable of stabilizing liquid-jet characteristics in favorable states, and also capable of preventing destruction of a vibration plate due to stress concentration, and destruction of piezoelectric elements due to moisture.

A first aspect of the present invention for solving the above problem is a liquid-jet head characterized by comprising: a passage-forming substrate where pressure generating chambers which communicates with a nozzle orifice are formed; piezoelectric elements which are provided on one surface of the passage-forming substrate with a vibration plate interposed therebetween, includes a lower electrode, a piezoelectric layer and an upper electrode; and a laminated electrode includes layers different from those forming the lower electrode and the upper electrode, provided on the vibration plate outward of a region which corresponds to each of the piezoelectric elements, and electrically connected to the lower electrode. The liquid-jet head is also characterized in that a stress relaxing layer is provided at least in regions corresponding to edge portions of the laminated electrode between the laminated electrode and the vibration plate, the stress relaxing layer including a material having a linear expansion coefficient greater than that of the vibration plate and less than that of the laminated electrode.

In the case of the first aspect, by providing the stress relaxing layer, it is possible to suppress stress concentration to the vibration plate, at least on a portion thereof corresponding to the edge portions of the laminated electrode. As a result, destruction of the vibration plate due to this stress concentration is prevented.

A second aspect of the present invention is the liquid-jet head of the first aspect, characterized in that the stress relaxing layer is provided only in the regions corresponding to the edge portions of the laminated electrode.

In the case of the second aspect, it is possible to more effectively suppress the stress concentration to the vibration plate on the portion thereof corresponding to the edge portion of the laminated electrode.

A third aspect of the present invention is the liquid-jet head of the first aspect, characterized in that the stress relaxing layer extends outward of a periphery of the laminated electrode.

In the third aspect, it is possible to more effectively suppress the stress concentration to the vibration plate on the portions thereof corresponding to the edge portions of the laminated electrode.

A fourth aspect of the present invention is the liquid-jet head of the first aspect, characterized in that the stress relaxing layer is made of a ceramic material.

In the fourth aspect, it is possible to more reliably suppress the stress concentration to the vibration, plate.

A fifth aspect of the present invention is the liquid-jet head of the fourth aspect, characterized in that the stress relaxing layer includes the same layer as the piezoelectric layer constituting the piezoelectric elements, and is separated from the piezoelectric layer constituting the piezoelectric elements.

In the fifth aspect, it is possible to form the stress relaxing layer relatively easily in the same process as that of the piezoelectric elements, and also, it is possible to effectively suppress transmission of stresses of the piezoelectric elements.

A sixth aspect of the present invention is the liquid-jet head of the first aspect, characterized in that a thickness of the stress relaxing layer is equal to or greater than that of the piezoelectric layer.

In the sixth aspect, the stress concentration occurring in the vibration plate and in the laminated electrode can be more reliably suppressed by the stress relaxing layer.

A seventh aspect of the present invention is the liquid-jet head of the first aspect, characterized in that the passage-forming substrate is a single crystal silicon substrate, and the vibration plate includes at least an elastic film made of silicon dioxide formed on a surface of the passage-forming substrate.

In the seventh aspect, although cracks due to the stress concentration are likely to occur particularly on the elastic film formed of silicon dioxide, it is possible to prevent the cracks on the elastic film by providing the stress relaxing layer.

An eighth aspect of the present invention is a liquid-jet head characterized by including: a passage-forming substrate on which pressure generating chambers each communicating with a nozzle orifice are provided, and a communicating portion communicating with each of the pressure generating chambers through a supply path is provided; piezoelectric elements which are provided on the passage-forming substrate with a vibration plate interposed therebetween, and includes a lower electrode, a piezoelectric layer and an upper electrode; and a reservoir forming plate which is joined to the surface of the passage-forming substrate, the surface facing the piezoelectric elements, and has a reservoir portion communicating with the communicating portion. The liquid-jet head is also characterized in that, in a region corresponding to the supply path, on the vibration plate at least in a region to which the reservoir forming plate is joined, a laminated electrode is provided, with a stress relaxing layer interposed therebetween, so as to be provided side by side along the direction in which the pressure generating chambers are provided in a line. The laminated electrode includes layers different from those constituting any one of the lower and upper electrodes, and is electrically connected to the lower electrode. The stress relaxing layer is formed of a material having a linear expansion coefficient greater than that of the vibration plate and less than that of the laminated electrode. The liquid-jet head is further characterized in that, in a region facing the communication portion along the laminated electrode, a discontinuous laminated electrode which is separated discontinuous from the laminated electrode, is provided parallel to the laminated electrode with the stress relaxing layer, which is provided continuously from a region corresponding to the laminated electrode, interposed therebetween.

In the eighth aspect, by providing the laminated electrode, a resistance value of the lower electrode provided as a common electrode of the piezoelectric elements, is substantially reduced, and occurrence of crosstalk and the like can be suppressed, thereby stable ejection characteristics can be obtained. Additionally, by providing the stress relaxing layer, stress concentration to the vibration plate due to stresses from the laminated electrode and the like can be suppressed, and it is possible to prevent destruction of the vibration plate due to the stress concentration. Furthermore, by providing the discontinuous laminated electrode, the reservoir forming plate and the passage-forming substrate can be joined favorably with each other, whereby it is possible to prevent the piezoelectric element from destruction due to the liquid infiltrating between the reservoir forming plate and the passage-forming substrate from the reservoir portion.

A ninth aspect of the present invention is the liquid-jet head of the eighth aspect, characterized in that the supply path is provided in a manner penetrating the passage-forming substrate.

In the ninth aspect, although cracks are likely to occur in a region of the vibration plate corresponding to the supply path, destruction of the vibration plate in that region can be prevented by providing the stress relaxing layer.

A tenth aspect of the present invention is the liquid-jet head of the eighth aspect, characterized in that the laminated electrode and the discontinuous laminated electrode are insulated from each other.

In the tenth aspect, it is possible to more reliably suppress voltage application to ink.

An eleventh aspect of the present invention is the liquid-jet head of the eighth aspect, characterized in that the stress relaxing layer is formed of a ceramic material.

In the eleventh aspect, it is possible to more reliably suppress the stress concentration to the vibration plate.

A twelfth aspect of the present invention is the liquid-jet head of the eleventh aspect, characterized in that the stress relaxing layer is formed of the same layer as the piezoelectric layer constituting the piezoelectric elements, and is separated from the piezoelectric layer constituting the piezoelectric elements.

In the twelfth aspect, it is possible to relatively easily form the stress relaxing layer in the same process as the piezoelectric elements, and also, it is possible to effectively suppress transmission of stresses at deformation of the piezoelectric elements.

A thirteenth aspect of the present invention is the liquid-jet head of the eighth aspect, characterized in that a thickness of the stress relaxing layer equal to or greater than that of the piezoelectric layer.

In the thirteenth aspect, stresses occurring in the vibration plate and in the laminated electrode are more reliably relaxed by the stress relaxing layer.

A fourteenth aspect of the present invention is the liquid-jet head of the eighth aspect, characterized in that the reservoir forming plate includes piezoelectric the element holding portion which protects the respective piezoelectric elements.

In the fourteenth aspect, it is possible to more reliably prevent destruction of the piezoelectric elements due to moisture.

A fifteenth aspect of the present invention is the liquid-jet head of the eighth aspect, characterized in that the passage-forming substrate is formed of a single crystal silicon substrate, and the vibration plate includes at least an elastic film formed of silicon dioxide formed on a surface of the passage-forming substrate.

In the fifteenth aspect, although cracks resulted from the stress concentration are likely to occur particularly on the elastic film formed of silicon dioxide, it is possible to prevent the cracks occur on the elastic film by providing the stress relaxing layer.

A sixteenth aspect of the present invention is a liquid-jet apparatus characterized by including a liquid-jet head of any one of the first to fifteenth aspects.

In the sixteenth aspect, it is possible to realize the liquid-jet apparatus enhanced in durability and reliability.

DESCRIPTION OF THE PREFERRED EMBODIMENTS

Hereinafter, the present invention will be described in detail based on embodiments.

Embodiment 1

Figure 1:
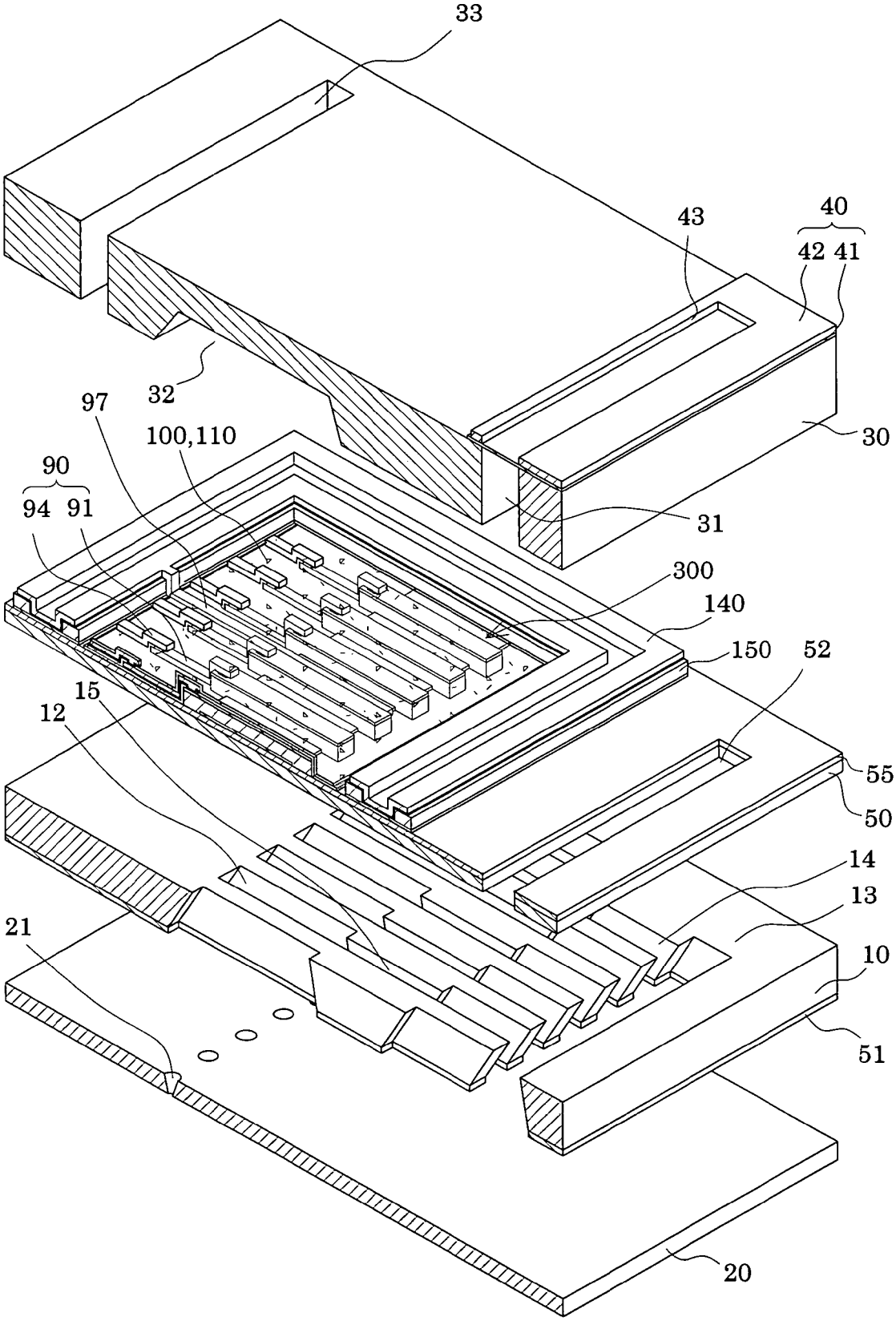
FIG. 1 is an exploded perspective view of a recording head according to Embodiment 1.
Figure 2A:
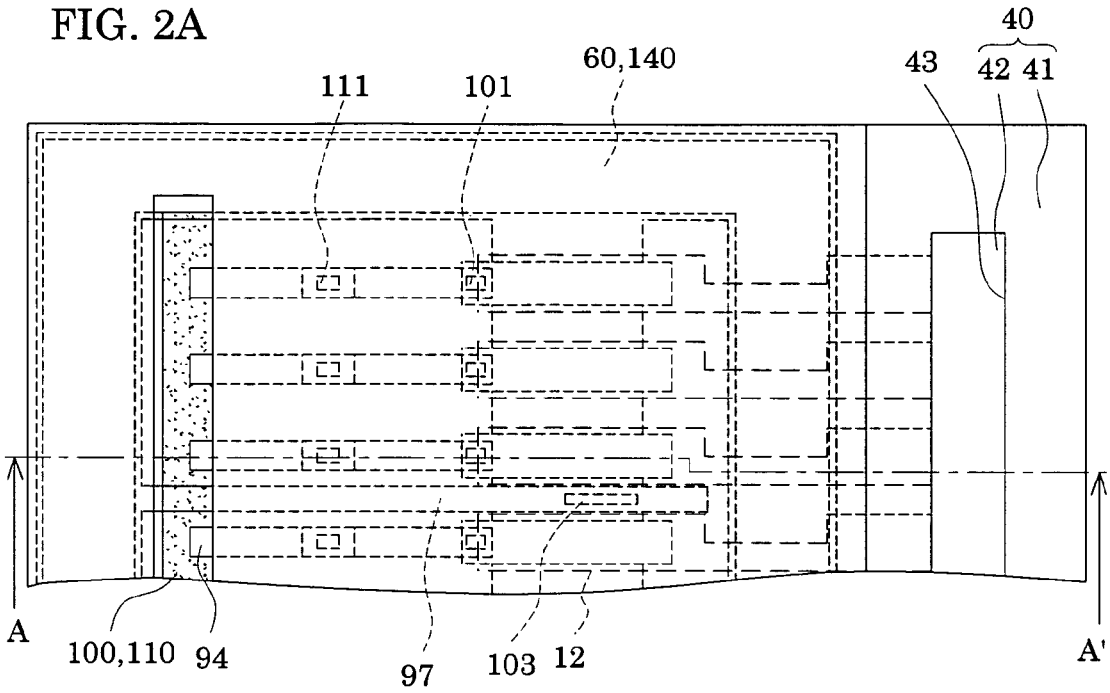
FIGS. 2A and 2B are a plan view and a cross-sectional view, respectively, of the recording head according to Embodiment 1.
Figure 2B:
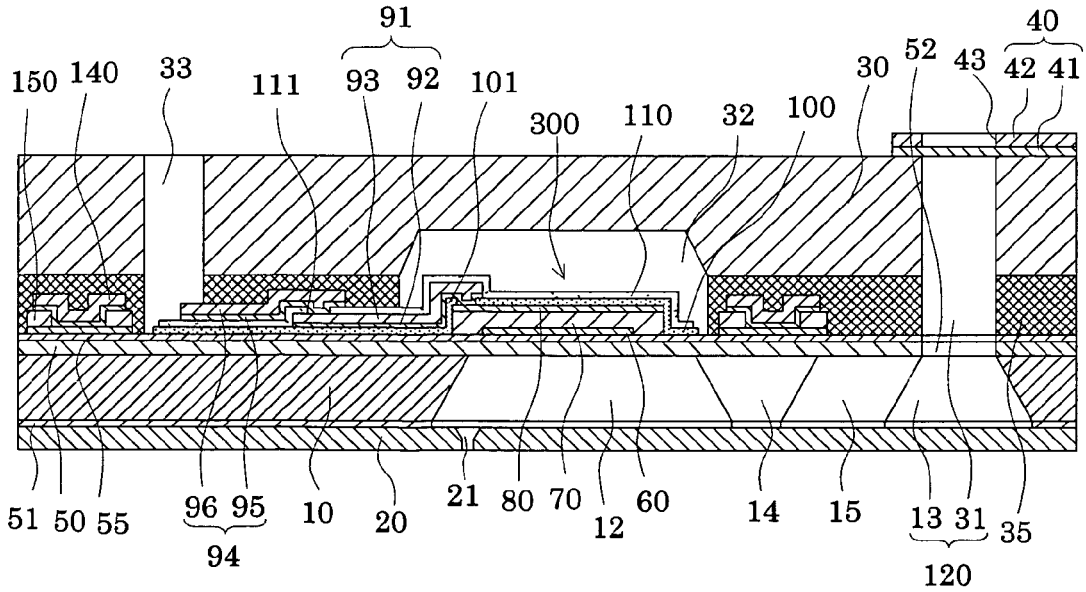

FIG. 1 is an exploded perspective view showing an ink-jet recording head according to Embodiment 1 of the present invention, and FIGS. 2A and 2B are a plan view of the ink-jet recording head shown in FIG. 1 and a cross-sectional view of the ink-jet recording head shown in FIG. 1 taken along the A-A' line in FIG. 2A, respectively. A passage-forming substrate 10 is a single crystal silicon substrate of a plane orientation (110) in the present invention, and as illustrated, on one surface thereof, an elastic film 50 formed of silicon dioxide and having a thickness ranging 0.5 to 2.0 μm is formed. On the passage-forming substrate 10, a plurality of pressure generating chambers 12 are provided in the direction of the passage-forming substrate 10. Additionally, on the passage-forming substrate 10, a communicating portion 13 is formed in an outer region in a longitudinal direction of the pressure generating chambers 12. The communicating portion 13 and each of the pressure generating chambers 12 communicate with each other with an ink communicating path 14 and an ink supply path 15 interposed therebetween. The ink communicating path 14 is formed in a width substantially equal to a width of each of the pressure generating chambers 12, and the ink supply path 15 is formed in a width narrower than the width of the each pressure generating chamber 12. Note that, .by communicating with a reservoir portion of a later described reservoir forming plate, the communicating portion 13 constitutes a part of a reservoir intended to be a common ink chamber of the respective pressure generating chambers 12. The ink supply path 15 keeps a flow-path resistance of ink flowing from the ink communicating path 14 to the each pressure generating chamber 12, constant.

To a surface having opening portions of the passage-forming substrate 10, a nozzle plate 20 to which nozzle orifices 21 are provided is fixed with a mask film 51 interposed therebetween by using an adhesive agent, a thermal adhesive film, or the like. The mask film 51 has been used as an etching mask in forming the pressure generating cambers 12. The nozzle orifices 21 communicate with the respective pressure generating chambers 12 in vicinities of edge portions of the pressure generating chambers 12, and the edge portions are opposite to the edge portions where ink supply paths 15 are provided. Note that the nozzle plate 20 is made of glass ceramic or stainless steel, a single crystal silicon substrate, or the like.

On the other hand, on a reverse side of the surface having opening portions of the passage-forming substrate 10, as described above, the elastic film 50 having a thickness of, for example, about 1.0 μm. On this elastic film 50, there is formed an insulation film 55 formed of zirconium oxide ($ZrO_2$) and having a thickness of, for example, about 0.4 μm, is formed. Furthermore, on the insulation film 55, a lower electrode film 60, a piezoelectric layer 70, and an upper electrode film 80 are laminated in a later described process, thus forming piezoelectric elements 300. The lower electrode film 60 is formed of platinum (Pt) and iridium (Ir) and has a thickness of, for example, about 0.2 μm. The piezoelectric layer 70 is formed of lead zirconate titanate (PZT) and has a thickness of, for example, about 1.0 μm. The upper electrode film 80 is formed of iridium (Ir) and has a thickness of, for example, about 0.05 μm.

As a material for the piezoelectric layer 70, a relaxer ferroelectric substance or the like may also be used. The relaxer ferroelectric substance is obtained by adding metal such as niobium, nickel, magnesium, bismuth, yttrium or the like to a ferroelectric piezoelectric material such as lead zirconate titanate (PZT). A composition thereof may be selected as appropriate in consideration of properties, applications and the like of the piezoelectric elements. As the composition, for example, $PbTiO_3$ (PT), $PbZrO_3$ (PZ), $Pb(Zr_xTi_{1-x})O_3$ (PZT), $Pb(Mg_{1/3}Nb_{2/3})O_3$—$PbTiO_3$ (PMN—PT), $Pb(Zn_{1/3}Nb_{2/3})O_3$—$PbTiO_3$ (PZN—PT), $Pb(Ni_{1/3}Nb_{2/3})O_3$—$PbTiO_3$ (PNN—PT), $Pb(In_{1/2}Nb_{1/2})O_3$—$PbTiO_3$ (PIN—PT), $Pb(Sc_{1/3}Ta_{2/3})O_3$—$PbTiO_3$ (PST—PT), $Pb(Sc_{1/3}Nb_{2/3})O_3$—$PbTiO_3$ (PSN—PT), $BiScO_3$—$PbTiO_3$ (BS—PT), $BiYbO_3$—$PbTiO_3$ (BY—PT) and the like can be cited.

Each of the piezoelectric elements 300 mentioned is a part including the lower electrode film 60, the piezoelectric layer 70 and the upper electrode film 80. In general, each of the piezoelectric element 300*s* is configured by providing one of the electrodes thereof as a common electrode, and patterning the other electrode and the piezoelectric layer 70 corresponding to the respective pressure generating chambers 12. Here, a portion where piezoelectric flexure is generated due to voltage application to both of the electrodes is referred to as a piezoelectric active portion, which includes any patterned one of the electrodes and the piezoelectric layer 70. In this embodiment, the lower electrode film 60 is provided as the common electrode of the piezoelectric elements 300, and the upper electrode film 80 is provided as the individual electrode of the piezoelectric element 300. However, it does not matter if a configuration described above is reversed for the convenience of arrangements of driver circuits and wiring. As a result of any one of the above configurations, the piezoelectric active portion is formed to each of the pressure generating chambers 12. Additionally, although this will be described in detail later, upper-electrode extraction electrodes 90 are connected to each upper electrode film 80 which is provided as the individual electrode of the respective piezoelectric elements 300, and through these upper-electrode extraction electrodes 90, voltage is applied to the respective piezoelectric elements 300.

Hereinafter, a structure of the piezoelectric element 300 will be described in detail. In this embodiment, the lower electrode film 60 provided as the common electrode of the piezoelectric element 300 is formed within a region facing the pressure generating chambers 12 in a longitudinal direction of the pressure generating chambers 12, and is continuously formed within regions according to the plural pressure generating chambers 12 in a direction along which the pressure generating chambers 12 are provided. Additionally, the lower electrode film 60 is provided so as to extend to a vicinity of an edge portion of the passage-forming substrate 10 in the direction in which the pressure generating chambers 12 are provided in a line. In this embodiment, the lower electrode film 60 is continuously provided surrounding the piezoelectric element 300 provided in a line and a periphery of the upper-electrode extraction electrodes 90. On the other hand, although the piezoelectric layer 70 and the upper electrode film 80 are basically provided in the region facing the pressure generating chambers 12, they are extended to regions outward of edge portions of the lower electrode film 60 in a longitudinal direction of the pressure generating chambers 12. The end faces of the lower electrode film 60 are covered with the piezoelectric layer 70.

Additionally, the layers constituting the above described piezoelectric elements 300 are covered with a first insulating film 100 formed of an inorganic insulating material, and the upper-electrode extraction electrodes 90 are connected to the upper electrode film 80 of the respective piezoelectric elements 300 with this first insulating film 100 interposed therebetween. To be more precise, each of the upper-electrode extraction electrodes 90 is, in this embodiment, includes a first lead electrode 91 connected to the upper electrode film 80 and a second lead electrode 94 connected to the first lead electrode 91. Moreover, the first lead electrode 91 is provided so as to extend on the first insulating film 100, and a vicinity of one edge of the first lead electrode 91 is connected to the upper electrode film 80 through a contact hole 101 formed in the first insulating film 100. Furthermore, this first lead electrode 91 and the layers constituting each of the piezoelectric elements 300 are additionally covered with a second insulating film 110 formed of an inorganic insulating material as in the case with the first insulating film 100. The second lead electrode 94 constituting the upper-electrode extraction electrode 90 is provided so as to extend on the second insulating film 110, and its one edge is connected to the other edge of the first insulating film 100 through a contact hole 111 formed in the second insulating film 110. Moreover, a vicinity of another edge of the second lead electrode 94 is electrically connected to a driver IC mounted on a later described reservoir forming plate 30.

Here, the first lead electrode 91 includes an adhering layer 92 and a metal layer 93. The adhering layer 92 is formed of, for example, nickel (Ni), chrome (Cr), titanium (Ti), copper (Cu), titanium tungsten (TiW) or the like, and the metal layer 93 is formed of, for example, gold (Au), aluminum (Al) or the like. Note that, in this embodiment, the adhering layer 92 is formed of titanium tungsten (TiW) and the metal layer 93 is formed of aluminum (Al), and the first lead electrode 91 has a thickness of about 1 μm. As in the case with the first lead electrode 91, the second lead electrodes 94 is constituted of an adhering layer 95 and a metal layer 96. In this embodiment, for example, the adhering layer 95 is formed of nickel chrome (NiCr) and the metal layer 96 is formed of gold (Au), and the second lead electrode 94 has a thickness of about 1 μm. Materials for the first and second insulating films 100 and 110 are not particularly limited to inorganic insulating materials. As the materials, for example, aluminum oxide ($AlO_x$), tantalum oxide ($TaO_x$) and the like can be cited, and inorganic amorphous materials are suitable in particular. It is preferable to use, for example, aluminum oxide ($AlO_x$) or the like.

Additionally, a first laminated electrode 140 formed of the same layer as the first lead electrode 91 (the adhering layer 92 and the metal layer 93) is provided on the lower electrode film 60 located outward of a region corresponding to the pressure generating chambers 12 provided in a line, and is electrically connected to the lower electrode film 60. Furthermore, a lower-electrode extraction electrode 97 extending from the first laminated electrode 140 is provided in regions between two piezoelectric elements 300 provided in a line, for example, in a ratio of approximately one lower-electrode extraction electrode 97, to 10 piezoelectric elements. That is, the lower-electrode extraction electrode 97 includes the adhering layer 92 and the metal layer 93 both constituting the first electrode 91. Moreover, the lower-electrode extraction electrode 97 is provided so as to extend from the first laminated electrode 140 along an extracting direction of the upper-electrode extraction electrode 90, whereby the lower-electrode extraction electrode 97 is connected to the lower electrode film 60 which is of a region corresponding to the pressure generating chambers 12, through a contact hole 103 provided in the first insulating film 100. Note that the adhering layer 92 is provided in order to prevent the lower electrode film 60 and the metal layer 93 which is made of aluminum (Al), from reacting with each other and thereby causing a mutual diffusion.

In the above described structure, a resistance value of the lower electrode film 60 provided as the common electrode of the piezoelectric elements 300 is substantially reduced, consequently it is possible to prevent occurrence of a voltage drop even when a large number of the piezoelectric elements 300 are driven at the same time. In particular, by forming plural lower-electrode extraction electrodes 97 continuously from the first laminated electrode 140, occurrence of the voltage drop can be more reliably prevented, whereby favorable and stable ink ejection characteristics can be constantly obtained.

Figure 3:
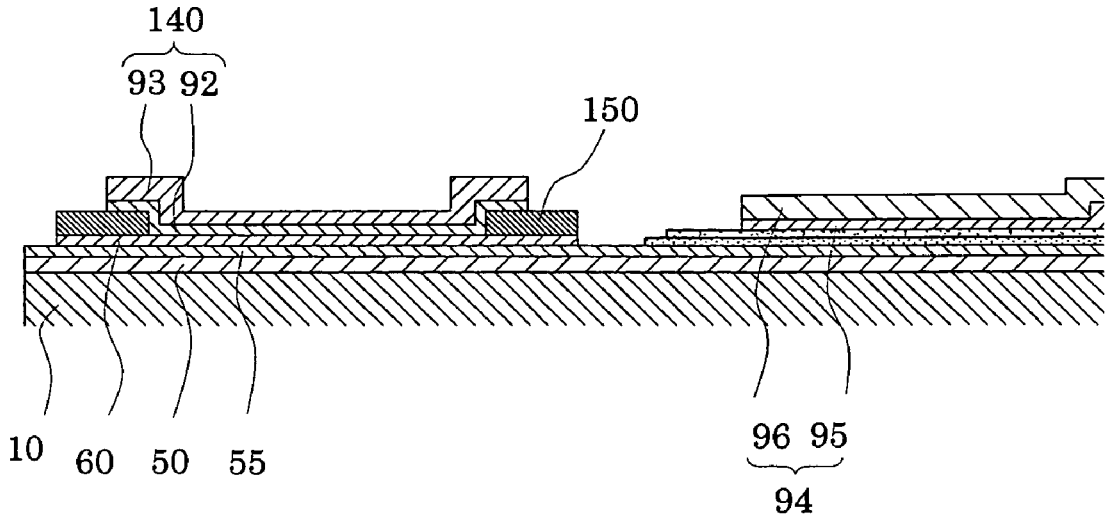
FIG. 3 is an enlarged cross-sectional view of a wiring structure of the recording head according to Embodiment 1.
Figure 4:
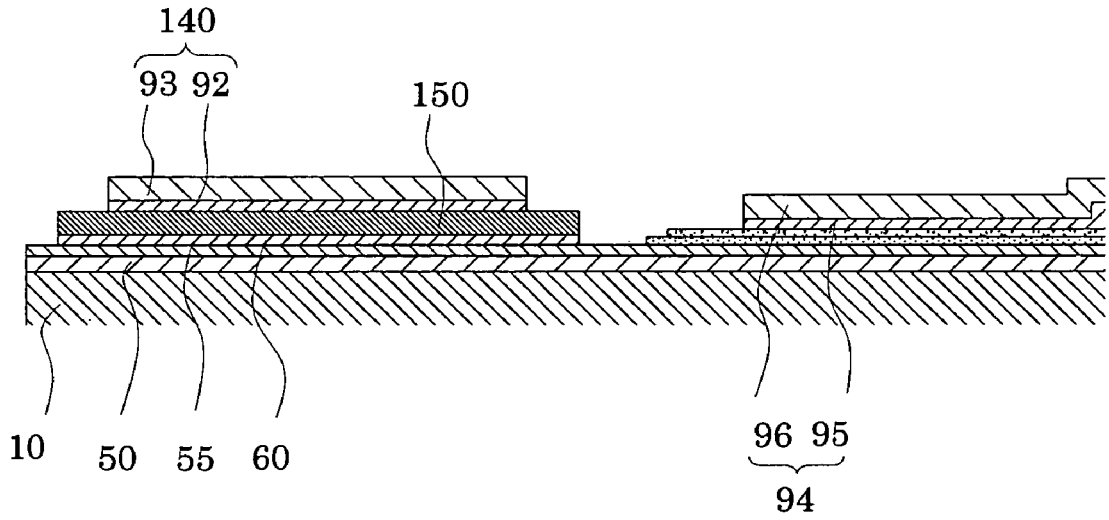
FIG. 4 is an enlarged cross-sectional view of wiring structure of the recording head according to Embodiment 1.

Additionally, in this embodiment, a stress relaxing layer 150 is provided between the first laminated electrode 140 and a vibration plate, which is made of a material having a liner expansion coefficient greater than that of the vibration plate and less than that of the first laminated electrode 140. It is sufficient that the stress relaxing layer 150 is provided at least in regions corresponding to edge portions of the first laminated electrode 140. That is, it is sufficient that the stress relaxing layer 150 is formed so that edge portions of the first laminated electrode 140 are located on the stress relaxing layer 150. For example, in this embodiment, the stress relaxing layer 150 is provided only in the regions corresponding to the edge portions of the first laminated electrode 140 as shown in FIG. 3. It is needless to say that, in addition to the regions corresponding to the edge portions of the first laminated electrode 140, the stress relaxing layer 150 may be provided, as shown in FIG. 4, also in all of a region under the first laminated electrode 140 continuously.

A material for the stress relaxing layer 150 is not particularly limited as long as the material has a linear expansion coefficient greater than that of a material constituting the vibration plate and less than that of a material constituting the laminated electrode 140. For example, in a case where the vibration plate includes plural layers as in the case with this embodiment, the material for the stress relaxing layer 150 may be the one having a linear expansion coefficient which is greater than that of a layer having the smallest linear expansion coefficient among the layers which constitute the vibration plate, and is less than that of a material constituting the laminated electrode 140. However, it is desirable that the material for the stress relaxing layer 150 has a liner expansion coefficient greater than that of the entire vibration plate. Specifically, a ceramic material or the like is favorably used as the material for the stress relaxing layer 150, and for example, in this embodiment, the stress relaxing layer 150 is formed of the same layer as the piezoelectric layer 70 constituting the piezoelectric elements 300, that is, lead zirconate titanate (PZT).

Moreover, by providing the above described stress relaxing layer 150 between the first laminated electrode 140 and the vibration plate, cracks of the vibration plate, especially of the elastic film 50, occurring in a periphery of the first laminate electrode 140 and originating from stresses in the vibration plate and in the laminated electrode 140, can be prevented. Additionally, although cracks of the vibration plate due to stress concentration are more likely to occur in regions corresponding to the edge portions of the first laminated electrode 140, these cracks of the vibration plate due to the stress concentration can be reliably prevented by providing the above described stress relaxing layer 150. Furthermore, as in the case with the present invention, when the stress relaxing layer 150 is provided only in the regions corresponding to the edge portions of the first laminated electrode 140, the cracks of the vibration plate can be more reliably prevented.

Note that, in a case where the stress relaxing layer 150 is formed of the same material as the piezoelectric layer 70 as in the case with this embodiment, it is preferable to separate the stress relaxing layer 150 from the piezoelectric layer 70 which constitute the piezoelectric elements 300. Thereby, it is possible to effectively suppress transmission of stresses when flexure occurs in the piezoelectric elements 300.

Moreover, while it is sufficient that the stress relaxing layer 150 is provided in the regions facing the edge portions of the first laminated electrode 140 as described above, it is desirable that the stress relaxing layer 150 be continuously provided striding the edge portions of the first laminated electrode 140. That is, although edge portions of the stress relaxing layer 150 may correspond respectively to the edge portions of the first laminated electrode 140, it is preferable that the edge portions of the stress relaxing layer 150 are located outward of the edge portions of the first laminated electrode 140. Specifically, in a case where each of the stress relaxing layer 150 and the first laminated electrode 140 have a thickness of about 1 μm as in the case with this embodiment, it is preferable that the edge portions of the stress relaxing layer 150 are each located at least 16 μm outward of the first laminated electrode 140. Furthermore, it is preferable that the stress relaxing layer 150 be formed to have a thickness equal to or greater than that of the first laminated electrode 140. The cracks of the vibration plate due to the stress concentration can be more reliably prevented by providing the above described stress relaxing layer 150 between the upper electrode film 60 and the first laminated electrode 140 all along the direction in which the upper electrode film 60 and the first laminated electrode 140 are provided side by side.

Hereinafter, a description will be given of results of calculation for stress conditions of vibration plates respectively in heads of Examples 1 and 2 and Comparative Example which are calculated with stress calculations using a finite element method. In the head of Example 1, a stress relaxing layer was provided continuously in a region corresponding to a lower electrode film. In the head of Example 2, a stress relaxing layer was provided only in regions corresponding to edge portions of a lower electrode film. In the head of Comparative Example, a stress relaxing layer was not provided. Specifically, when each of the heads of Embodiments 1 and 2 and Comparative Example was manufactured, a first laminated metal was formed on a lower electrode film under a predetermined temperature, thus the temperature is lowered by 300° C. Then, stresses occurring in an elastic film (the vibration plate) after the cooling were calculated respectively in a portion (with Si) of the vibration plate under which the passage-forming substrate existed, and in a portion (without Si) of the vibration plate under which the passage-forming substrate did not exist. The results thereof are shown in Table 1 below.

TABLE 1

| | "with Si" | | "without Si" | |
|---|---|---|---|---|
| | stress (MPa) | ratio (%) | stress (Mpa) | ratio (%) |
| Comparative Example | 182 | 100 | 183 | 100 |
| Example 1 | 115 | 63 | 115 | 63 |
| Example 2 | 92 | 51 | 50 | 27 |

As shown in Table 1, in the head of Comparative Example, relatively large stresses occurred in the elastic film equally in both of the portions "with Si" and "without Si." On the contrary, in the heads of Examples 1 and 2 where the stress relaxing layers were provided, it is found that stresses occurring in the respective elastic films were obviously reduced. Particularly in the head of Example 2 where the stress relaxing layer was provided only in regions corresponding to edge portions of the first laminated electrode, a stress occurring in the elastic film in the case of "with Si" was reduced to approximately half of the comparable stress in the head of Comparative Example. In the head of Example 2, particularly in a case of "without Si" a stress was considerably reduced to approximately 30% of the comparable stress in the head of Comparative Example.

As is apparent from the results, the cracks of the vibration plate due to the stresses in the vibration plate and in the first laminated electrode 140 can be more reliably prevented according to the configuration of the present invention where the stress relaxing layer is provided between the first laminated electrode and the vibration plate.

Figure 5A:
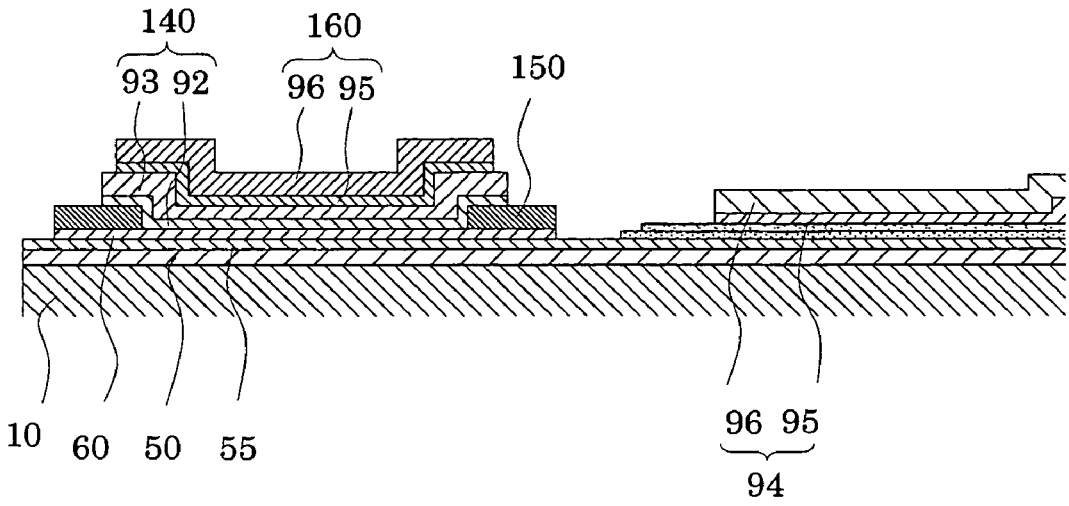
FIGS. 5A and 5B are enlarged cross-sectional views of wiring structure of the recording head according to Embodiment 1.
Figure 5B:
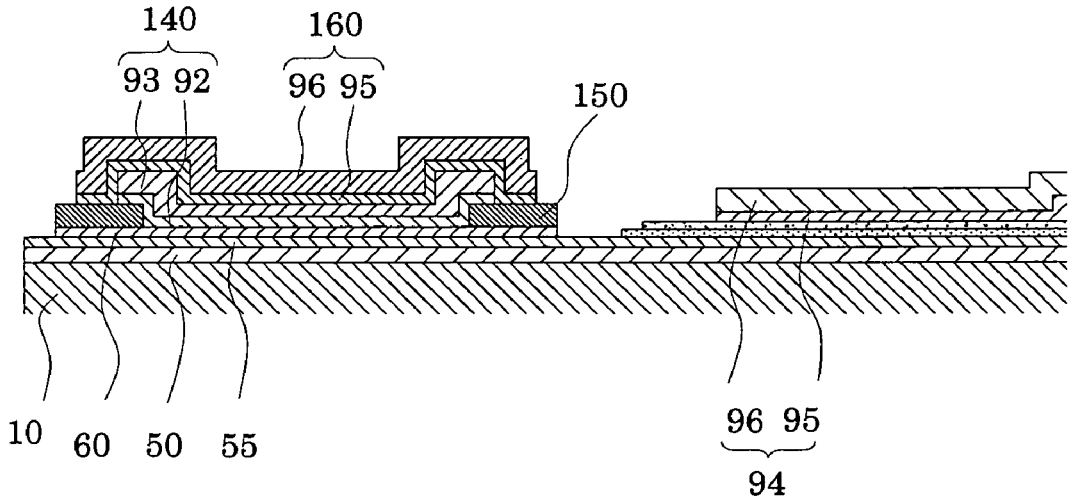

Note that, in this embodiment, only the first laminated electrode 140 is provided on the lower electrode film 60 which is located outward of a region corresponding to the pressure generating chambers 12, with the stress relaxing layer 150 interposed therebetween. However, a second laminated electrode 160 formed of the same layers (the adhering layer 95 and the metal layer 96) as the second lead electrode 94 may be additionally provided as shown in FIGS. 5A and 5B. Moreover, the second laminated electrode 160 may be provided in a width narrower than the first laminated electrode 140 as shown in FIG. 5A, otherwise, may be formed in a width wider than the first laminated electrode 140, for example, as shown in FIG. 5B.

Figure 6:
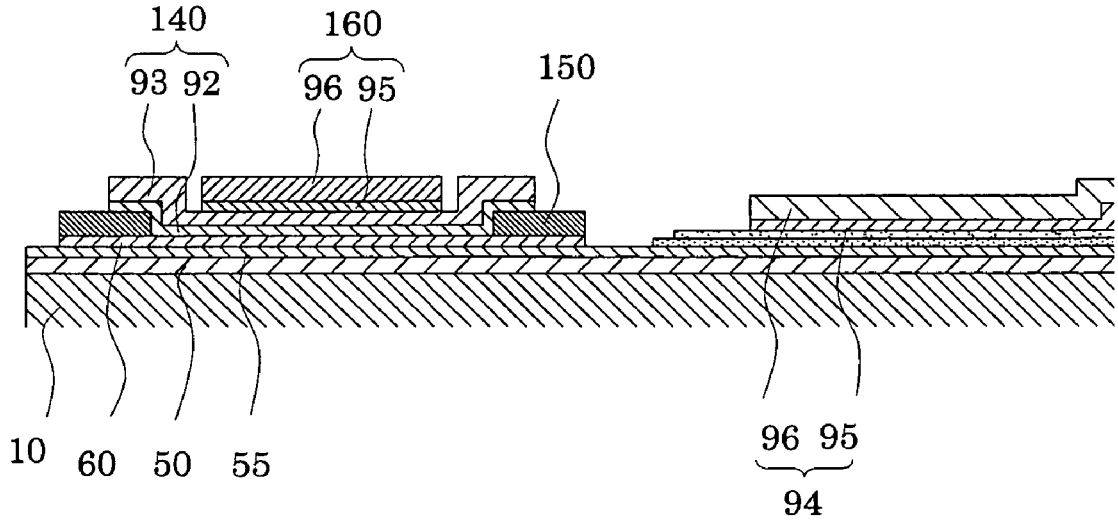
FIG. 6 is enlarged cross-sectional view of wiring structure of the recording head according to Embodiment 1.

Additionally, in a case where the stress relaxing layer 150 is provided only in regions corresponding to edge portions of the lower electrode film 60 as in the case with this embodiment, it is preferable that the second laminated electrode 160 is provided as shown in FIG. 6 only in regions where the stress relaxing layer 150 is not formed. Thereby, surfaces of the first and second laminated electrodes 140 and 160 are of almost same height, and it is possible to favorably join the later described reservoir forming plate 30 to the passage-forming substrate 10 by using an adhesive agent or the like.

The reservoir forming plate 30 is joined on a surface where the piezoelectric elements 300 are provided of the passage-forming substrate 10 through an adhesive agent 35. The reservoir forming plate 30 includes a reservoir portion 31 in a region thereof corresponding to the communicating portion 13 of the passage-forming substrate 10. In this embodiment, the reservoir portion 31 penetrates the reservoir forming plate 30 in a thickness direction, and provided along the direction in which the pressure generating chambers 12 are provided in a line. The reservoir portion 31 is allowed to communicate with the communicating portion 13 through a penetrated portion 52, thus constituting a reservoir 120 serving as a common ink chamber for the respective pressure generating chambers 12. Additionally, on the reservoir forming plate 30, a piezoelectric element holding portion 32 is provided in a region facing the respective piezoelectric elements 300, which makes it possible to secure spaces large enough not to disturb movements of the respective piezoelectric elements 300. Since the piezoelectric elements 300 are formed inside the piezoelectric element holding portion 32, they are protected in a state where the piezoelectric elements 300 are not influenced from external environments. Note that each of the piezoelectric element holding portions 32 may or may not be sealed. Furthermore, in another side of a region of the piezoelectric element holding portion 32 opposite to the side thereof facing the reservoir 31, a through-hole 33 through which the second lead electrodes 94 are exposed is formed penetrating the reservoir forming plate 30 in a thickness direction thereof. Moreover, although this is not illustrated, by connection wiring provided in a line in the through-hole 33, the driver IC mounted on the passage-forming substrate 10 is electrically connected to the second lead electrodes 94 and to the lower electrode film 60.

Note that, while glass, a ceramic material, metal, resin and the like can be cited as a material for the reservoir forming plate 30, it is more preferable that the reservoir forming plate 30 is formed of a material having a thermal expansion coefficient substantially equal to that of the passage-forming substrate 10. In this embodiment, the reservoir forming plate 30 is formed of a single crystal silicon substrate which is the same material as the passage-forming substrate 10.

Additionally, on the reservoir forming plate 30, a compliance plate 40 formed of a sealing film 41 and a fixed plate 42 is joined. The sealing film 41 is formed of a material (for example, a polyphenylene sulfide (PPS) film having a thickness of 6 μm) which is low in rigidity and has flexibility. Accordingly, one of the planes of the reservoir portion 31 is sealed with the sealing film 41. The fixed plate 42 is made of a hard material such as metal (for example, a plate of stainless steel (SUS) having a thickness of 30 μm, or the like) In the fixed plate 42, a region facing the reservoir 120 is an opening portion 43 where the fixed plate 42 is completely removed in a thickness direction thereof. Therefore, the plane of the reservoir 120 is sealed only with the sealing film 41 having flexibility.

In the ink-jet recording head according to this embodiment, ink is taken in from external ink supply means which is not illustrated, and after an interior ink path from the reservoir 120 to the nozzle orifices 21 is filled up with ink, a voltage is applied in accordance with a recording signal from the driver IC (not illustrated) mounted on the reservoir forming plate 30, between the lower electrode film 60 and the upper electrode film 80 which correspond to each of the pressure generating chambers 12. As a result, the elastic film 50, the insulating film 55, the lower electrode film 60 and the piezoelectric layer 70 are caused to undergo flexure deformation. Accordingly, pressure in each of the pressure generating chambers 12 is increased, hence ink droplets are ejected through the nozzle orifices 21.

Embodiment 2

Figure 7:
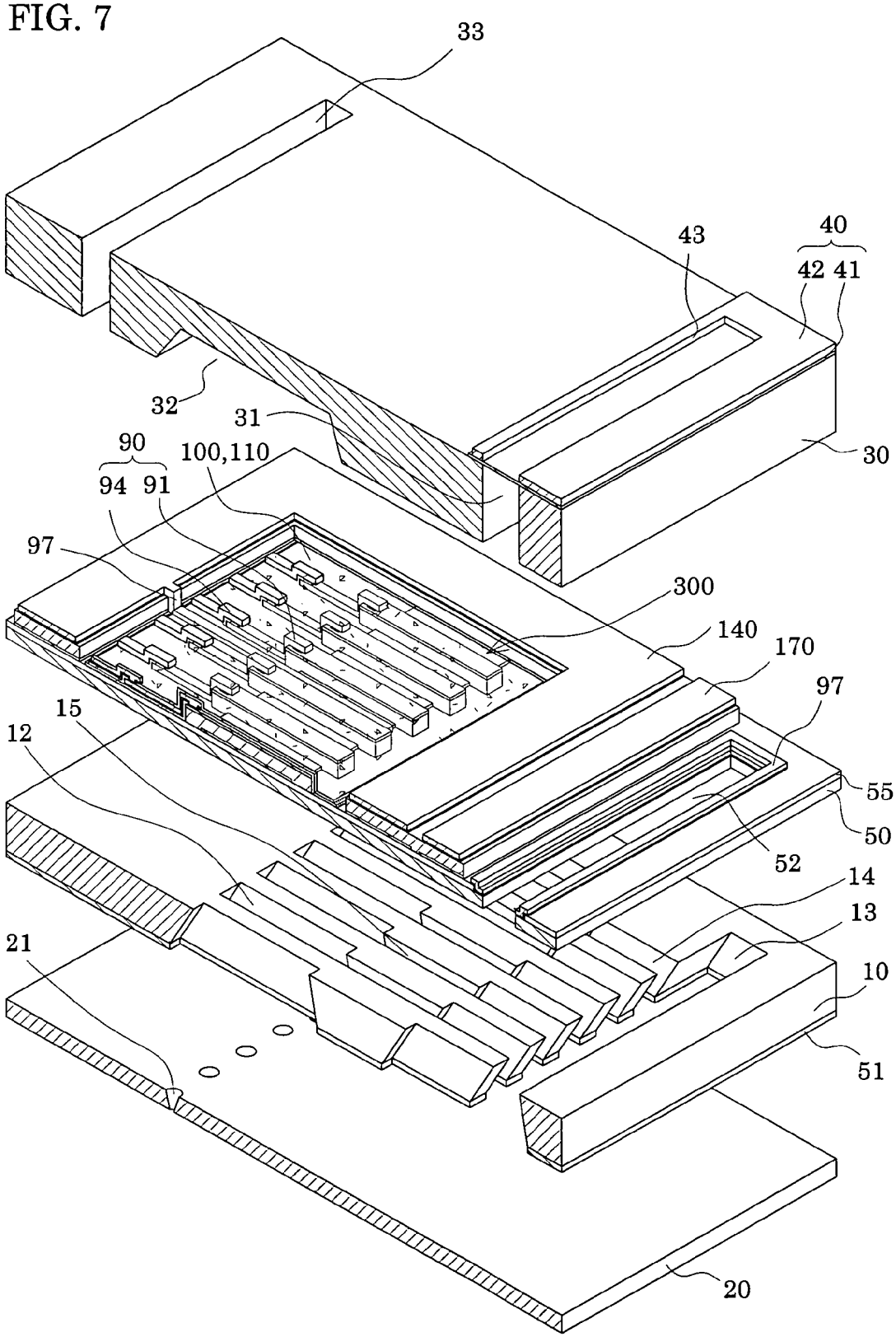
FIG. 7 is an exploded perspective view of a recording head according to Embodiment 2.
Figure 8A:
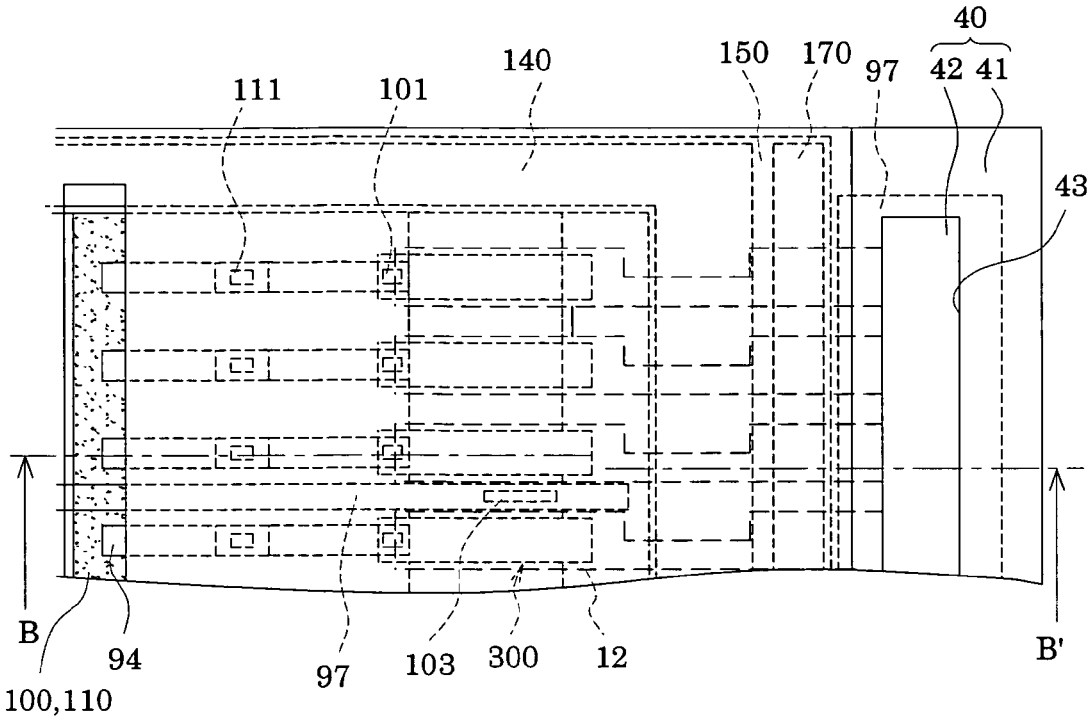
FIGS. 8A and 8B are a plan view and a cross-sectional view, respectively, of the recording head according to Embodiment 2.
Figure 8B:
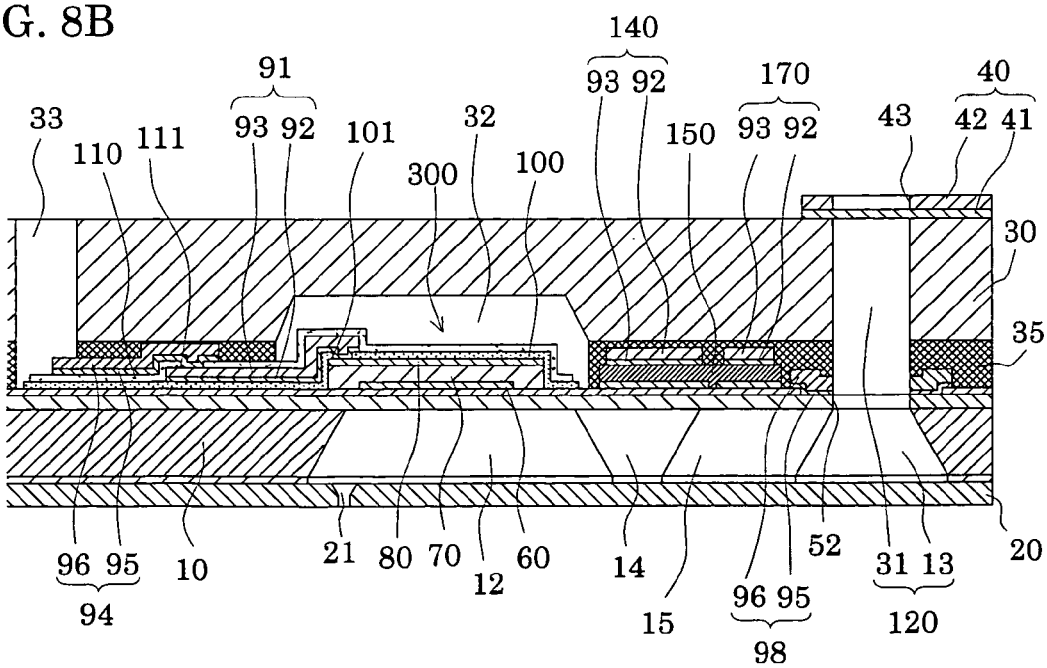
Figure 9:
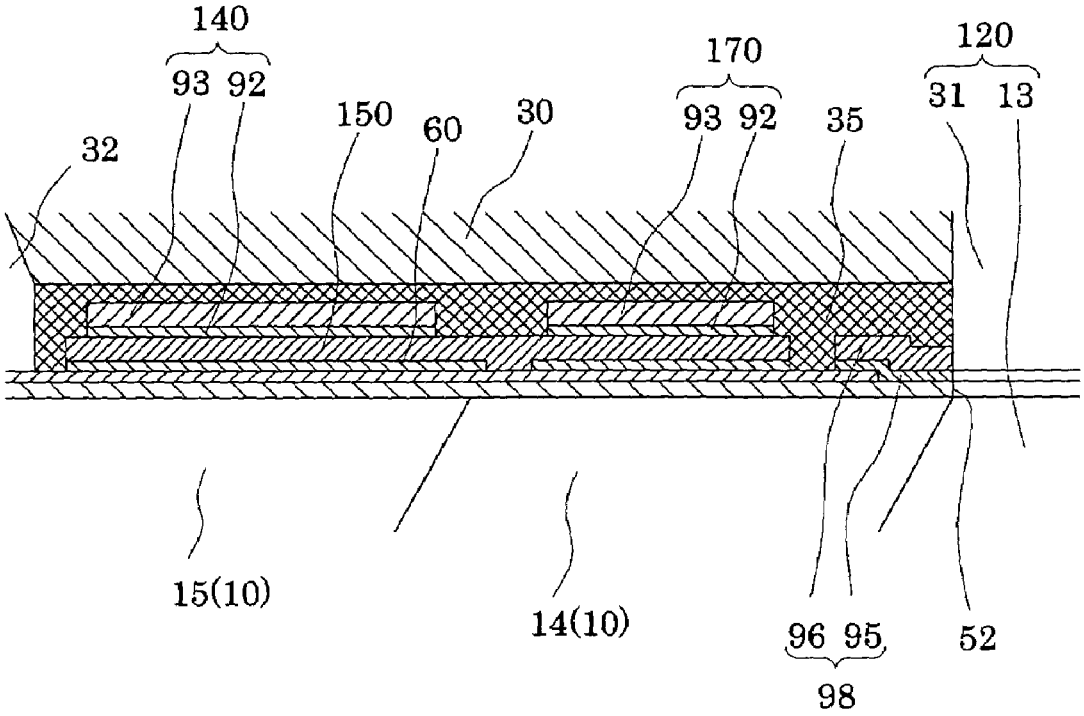
FIG. 9 is an enlarged cross-sectional view of the recording head according to Embodiment 2.

FIG. 7 is an exploded perspective view showing an ink-jet recording head according to Embodiment 2. FIGS. 8A and 8B are a plan view of the ink-jet recording head in Embodiment 2 shown in FIG. 7, and a cross-sectional view of the same taken along with a B-B' line of FIG. 8A, respectively. FIG. 9 is a cross-sectional view where a part of FIG. 8B is enlarged. Note that the members that have been already described in Embodiment 1 have the same reference numerals to those in Embodiment 1, and also the same explanations to those of Embodiment 1 will be omitted.

As it has been described in Embodiment 1, the layers constituting the piezoelectric element 300 are covered with the first insulating film 100 formed of an inorganic insulating material, and the upper-electrode extraction electrodes 90 are connected to the upper electrode film 80 of the respective piezoelectric elements 300 through this first insulating film 100. To be more precise, each of the upper-electrode extraction electrodes 90 is, in this embodiment, includes of the first lead electrode 91 connected to the upper electrode film 80 and the second lead electrode 94 connected to the first lead electrode 91. Moreover, the first lead electrode 91 is provided so as to extend on this first insulating film 100, and a vicinity of one edge portion of the first lead electrode 91 is connected to the upper electrode film 80 through a contact hole 101 formed in the first insulating film 100. Furthermore, this first lead electrode 91 and the layers constituting the piezoelectric elements 300 are additionally covered with the second insulating film 110 formed of an inorganic insulating material as well as the first insulating film 100. The second lead electrode 94 constituting the upper-electrode extraction electrode 90 is provided so as to extend on the second insulating film 110, and a part of the second lead electrode 94 is connected to the other edge portion of the first lead electrode 91 through a contact hole 111 formed in the second insulating film 110. Moreover, a vicinity of the other edge portion of the second lead electrode 94 is electrically connected to a driver IC mounted on the reservoir forming plate 30.

Additionally, in this embodiment, a discontinuous metal layer 98 remains in a region on the elastic film 50 and the insulating film 55 which corresponds to a peripheral portion of an opening of the communicating portion 13. The discontinuous metal layer 98 includes the adhering layer 95 and the metal layer 96 which are also included in the second lead electrodes 94, but the discontinuous metal layer 98 is not connected to the second lead electrodes 94. This discontinuous metal layer 98 is formed so as to cover the penetrated portion 52 formed in the elastic film 50 and the insulating film 55, and functions as an etching stop layer when the communicating portion 13 is formed by performing anisotropic etching on the passage-forming substrate 10. Then, after forming the communication portion 13, a part of the discontinuous metal layer 98 which is in a region facing the penetrate portion 52 is removed, and as a result, the rest of the discontinuous metal layer 98 remains in the region corresponding to the peripheral portion of the opening in the communicating portion 13.

In addition, a first laminated electrode 140 is provided outward of the region which corresponds to the pressure generating chambers 12 provided in a line. The first laminated electrode 140 includes layers different from those of the lower electrode film 60 and the upper electrode film 80, but the same layers as those of the first lead electrode 91 (the adhering layer 92 and the metal layer 93) in this embodiment. Furthermore, this first laminated electrode 140 is electrically connected to the lower electrode film 60. Note that, in this embodiment, although the first laminated electrode 140 is provided on the lower electrode film 60, it is not limited to this configuration. That is, as long as the first laminated film 140 and the lower electrode film 60 are electrically connected to each other, it is not required that the lower electrode film 60 is provided under the first laminated electrode 140. Furthermore, a lower-electrode extraction electrode 97 extended from the first laminated electrode 140 is provided between the piezoelectric elements 300 provided in a line, for example, in the ratio of 10 piezoelectric elements 300 to one lower-electrode extraction electrode 97. That is, the lower-electrode extraction electrode 97 includes the adhering layer 92 and the metal layer 93 both constituting the first electrode 91. Moreover, the lower-electrode extraction electrodes 97 are provided from the first laminated electrode 140 in the direction in which the upper-electrode extraction electrode 90 are provided side by side. Whereby the lower-electrode extraction electrodes 97 are connected to the lower electrode film 60 in regions corresponding to the pressure generating chambers 12 through contact holes 103 provided in the first insulating film 100.

Additionally, the stress relaxing layer 150 is provided between the first laminated electrode 140 and the vibration plate, which is made of a material having a liner expansion coefficient greater than that of the vibration plates and less than that of the first laminated electrode 140. Although it is sufficient that the stress relaxing layer 150 is provided at least in regions corresponding to edge portions of the first laminated electrode 140, for example, the stress relaxing layer 150 is provided in a region under the first laminated electrode 140 continuously all over the region in this embodiment.

Moreover, by providing the above described stress relaxing layer 150 between the first laminated electrode 140 and the vibration plate, cracks of the vibration plate, especially of the elastic film 50, which occur in a periphery of the first laminate electrode 140 as a result of stresses in the vibration plates and in the laminated electrode 140 can be prevented. In this embodiment, cracks of the vibration plates are likely to occur particularly in regions facing the ink communicating paths 14, the ink supply paths 15 and the like, since the ink communicating paths 14, the ink supply paths 15 and the like are provided so as to penetrate the passage-forming substrate 10. However, the cracks of the vibration plates can be more reliably prevented by providing stress relaxing layer 150.

Additionally, as shown in FIG. 9, in a region of the communicating path 13 of the first laminated electrode 140 formed in a region corresponding to a supply path through which each of the pressure generating chambers 12 and the communicating portion 13 communicate with each other, a discontinuous laminated electrode 170 is provided in a line while it is electrically separated from the first laminated electrode 140. In this embodiment, the supply path corresponds to the ink communicating path 14 and the ink supply path 15. This discontinuous laminated electrode 170 includes the adhering layer 92 and the metal layer 93 as in the case with the first laminated electrode 140, in this embodiment. Furthermore, a stress relaxing layer 150 is provided between the above described discontinuous laminated electrode 170 and the vibration plate, which is extended from a region corresponding to the first laminated electrode 140. Although the stress relaxing layer 150 is formed in a region corresponding to the first laminated electrode 140 and the discontinuous laminated electrode 170 in this embodiment, it may be extended to a region under the discontinuous metal layer 98 provided in the peripheral portion of the opening of the communication portion 13. Note that it is preferable that the lower electrode film 60 in a region under the discontinuous laminated electrode 170 is electrically separated from the lower electrode film 60 constituting the piezoelectric elements 300.

As described above, between the first laminated electrode 140 and the vibration plate, the stress relaxing layer 150 formed of a material having a liner expansion coefficient greater than that of the vibration plate and less than that of the first laminated electrode 140, is provided. In this embodiment, the stress relaxing layer 150 is provided in a region under the first laminated electrode 140 continuously all over the corresponding region.

Additionally, as has been described above, the reservoir forming plate 30 including the reservoir portion 31 is joined onto a surface having the piezoelectric elements 300 of the passage-forming substrate 10. Although the reservoir forming plate 30 is joined to the passage-forming substrate 10 through the adhesive agent 35 as described in Embodiment 1, the discontinuous metal layer 98, the first laminated layer 140 and the like are formed on the passage-forming substrate 10 in the regions facing the ink supply paths 15 and the ink communicating paths 14. Accordingly, in practice, the reservoir forming plate 30 is joined to the discontinuous metal layer 98, the first laminated layer 140 and the like through the adhesive agent 35.

Furthermore, in this embodiment, the discontinuous laminated electrode 170 is provided in the regions of the first laminated electrode 140 which face the communication portion 13, while electrically separated from the first laminated electrode 140. Accordingly, the reservoir forming plate 30 is joined to this discontinuous laminated electrode 170 as well as the discontinuous metal layer 98 and the first laminated layer 140 through the adhesive agent 35.

Consequently, it is possible to join the reservoir forming plate 30 and the passage-forming substrate 10 extremely and favorably with each other, and ink inside the reservoir 120 is prevented from infiltrating between the reservoir forming plate 30 and the passage-forming substrate 10 thus entering the piezoelectric element holding portions 32. Moreover, since the discontinuous laminated electrode 170 and the first laminated electrode 140 are electrically separated from each other, that is, insulted from each other. Accordingly, in the case where the ink infiltrated the discontinuous laminated electrode 170, there is no risk that: a voltage is applied to the ink, thereby electrolysis is operated on the ink, and gas and foreign substances are generate, thereby ejection of ink droplets comes to be inferior. Moreover, this configuration is particularly effective in a case where, as in the case with this embodiment, the discontinuous metal layer 98 including the metal layer formed of gold (Au) is provided in the peripheral portion of the communicating portion 13, and the reservoir forming plate 30 is joined onto this discontinuous laminated layer 98. In other words, although ink is likely to infiltrate between the discontinuous metal layer 98 and the adhesive agent 35 because the discontinuous metal layer 98 (the metal layer 96) has low adhesion with the adhesive agent 35, it is possible to reliably prevent the ink from entering the piezoelectric element holding portions 32, by providing the discontinuous laminated-electrode 170.

Figure 10:
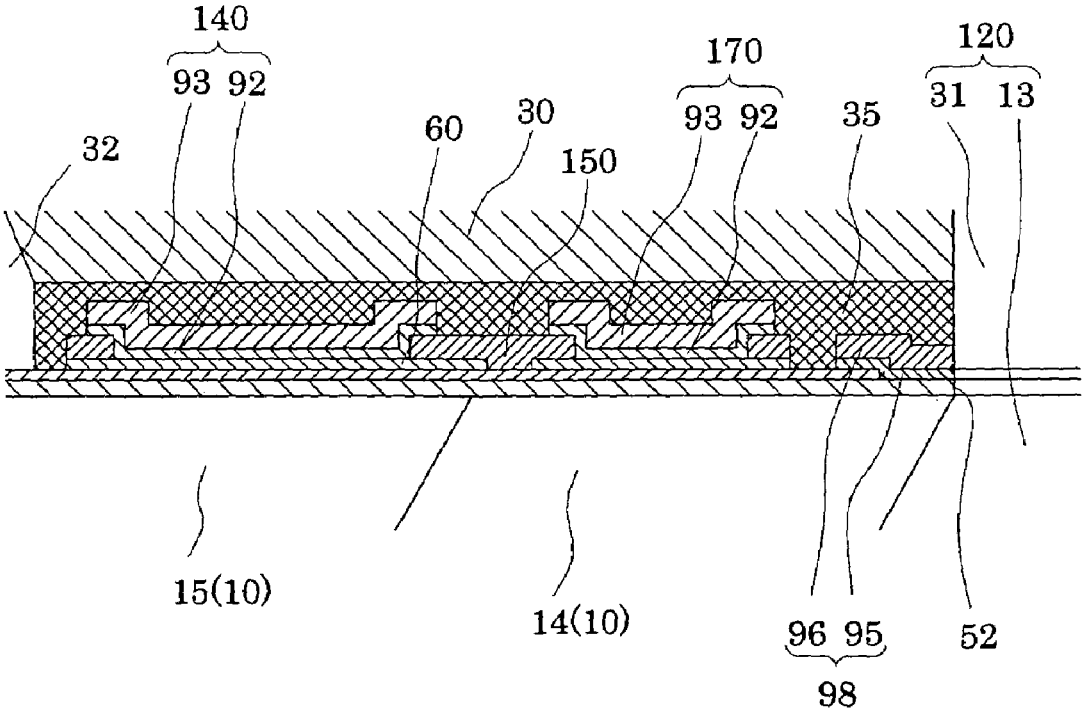
FIG. 10 is an enlarged cross-sectional view showing a modification example of the recording head according to Embodiment 2.

Note that, the stress relaxing layer 150 can prevent ink from entering the piezoelectric element holding portions 32 even if the stress relaxing layer 150 is separated into a region corresponding to the discontinuous laminated electrode 170 and a region corresponding the first laminated electrode 140 as described above. However, the stress relaxing layer 150 extends in regions which correspond to the discontinuous laminated electrode 170 and the first laminated electrode 140, in view of preventing the destruction of the vibration plate. This is because, if the stress relaxing layer 150 is separated into a region corresponding to the discontinuous laminated electrode 170 and a region corresponding the first laminated electrode 140, the stress concentration occurs in the vibration plate in regions corresponding to edge portions of the stress relaxing layer 150, whereby cracks and the like are more likely to occur therein. That is, it is sufficient that the stress relaxing layer 150 is formed continuously at least in a region between the discontinuous laminated electrode 170 and the first laminated electrode 140. For example, as shown in FIG. 10, in regions under the discontinuous laminated electrode 170 and the first laminated electrode 140, the stress relaxing layer 150 may be formed only in regions which correspond to respective edge portions of the discontinuous laminated electrode 170 and the first laminated electrode 140. Obviously, in this configuration, it is also possible to reliably prevent ink from entering in the piezoelectric element holding portions 32 while preventing the destruction of the vibration plate at the same time.

Figure 11:
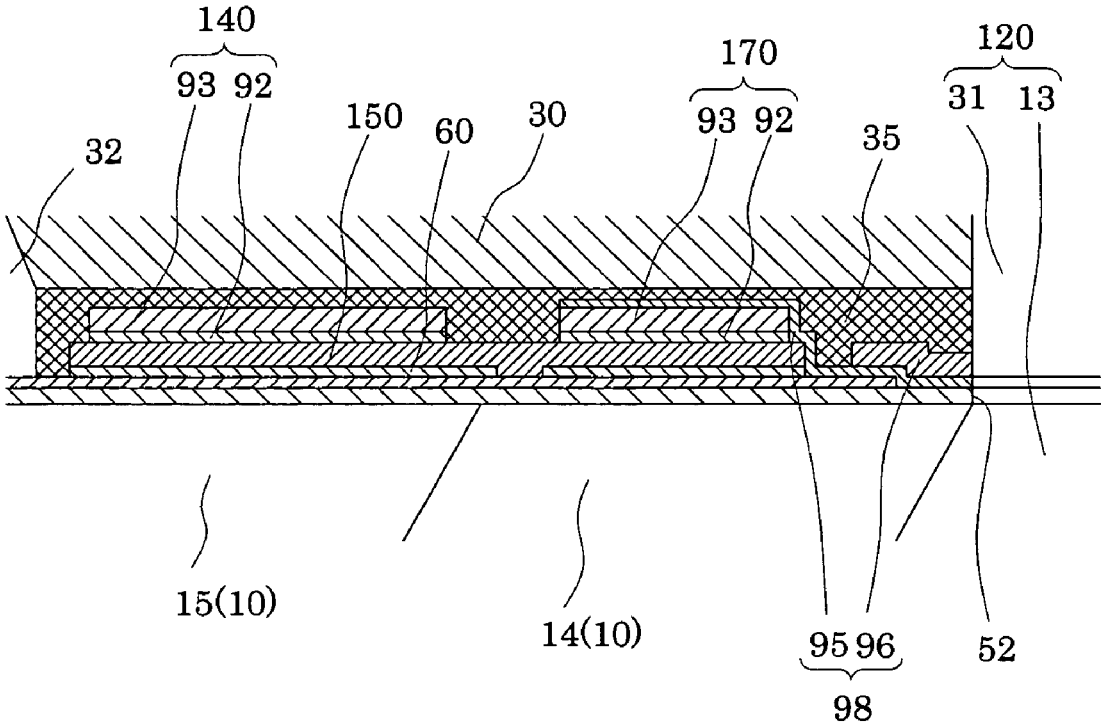
FIG. 11 is an enlarged cross-sectional view showing another modification example of the recording head according to Embodiment 2.

Moreover, in a case where the discontinuous metal layer 98 formed of the adhering layer 95-and the metal layer 96 is provided in the peripheral portion of the opening of the communicating portion 13, as in the case with this embodiment, for example, the adhering layer 95 constituting the discontinuous metal layer 98 may be extended onto the discontinuous laminated electrode 170, as shown in FIG. 11. As the adhering layer 95 has high adhesion with the adhesive agent 35, it is possible to more reliably prevent ink from entering the piezoelectric element holding portions 32. Moreover, another adhering layer formed of a material which is highly adhesive to the adhesive agent 35, that is, for example, titanium tungsten (TiW), nickel chrome (NiCr) or the like, may be provided besides the discontinuous metal layer 98. It is needless to say that the same effect can also be obtained in this configuration. Additionally, by providing this adhering layer also on the discontinuous metal layer 98, it is possible to integrate the discontinuous metal layer 98 and the discontinuous laminated electrode 170.

Other Embodiments

Although the embodiments of the present invention have been described heretofore, the present invention is not limited to the above described embodiments. For example, although the configuration, where laminated electrodes with one or two layers (the first and second laminated electrodes) are formed on a lower electric film, has been explained in the above described embodiments, the present invention is not limited to this configuration. Obviously, laminated electrodes with three or more layers, may be provided on the lower electrode film. Even in the case of adopting this configuration, cracks of a vibration plate as a result of stress concentration, can be prevented by providing the above described stress relaxing layer between a vibration plate and the laminated electrodes.

Additionally, the configuration has been explained where the lower electrode film 60 is provided so as to extend to the vicinity of the edge portion of the passage-forming substrate 10 in a direction in which the pressure generating chambers 12 are provided in a line, moreover, it is provided continuously so as to surround the plural piezoelectric elements 300 provided in a line and the upper-electrode extraction electrodes 90. However, the present invention is not limited to this configuration, the lower electrode film 60 may be provided only in a region corresponding to the pressure generating chambers 12. Even in the case of adopting this configuration, a voltage drop occurring when the piezoelectric elements 300 are driven can be prevented, as long as the first and second laminated electrodes 140 and 160 are electrically connected to the lower electrode film 60 in the region corresponding to the pressure generating chambers 12. Furthermore, the configuration has been explained where the stress relaxing layer is provided between the lower electrode film and the laminated electrode (the first laminated electrode). It is sufficient that the stress relaxing layer be provided between a vibration plate and the laminated electrode. For example, the stress relaxing layer may be provided under the lower electrode film.

Moreover, in Embodiment 2 described above, for example, the configuration is adopted where the discontinuous laminate electrode is provided only in the region corresponding to the ink communicating portions and the ink supply paths, but the present invention is not limited to this configuration. However, the discontinuous laminate electrode may be provided continuously all over a periphery of the piezoelectric element holding portion. Accordingly, ink attached on an outer surface of a head when printing is performed, can be prevented from entering the piezoelectric element holding portions, and destruction of piezoelectric elements due to the ink can be more reliably prevented. Additionally, although in Embodiment 2 described above, the discontinuous laminate electrode includes only the same layers as the first laminated electrode, the present invention is not limited to this configuration. For example, the discontinuous laminate electrode may include a plurality of layers. In any case, it is sufficient that the discontinuous laminate electrode is formed so as to have a height equal to or higher than heights of the films which are formed around the discontinuous laminate electrode, the films including the first laminated electrode and the like. Furthermore, in Embodiment 2 described above, although the upper-electrode extraction electrode includes the first and second lead electrodes, the present invention is not limited to this configuration. For example, the upper-electrode extraction electrode may include any one of the first and second lead electrodes, and furthermore, the first laminated electrode and the discontinuous laminated electrode may be respectively formed of the same layer as the one lead electrode. Accordingly, destruction of a vibration plate as a result of stress concentration can be prevented while simplifying manufacturing processes.

Figure 12:
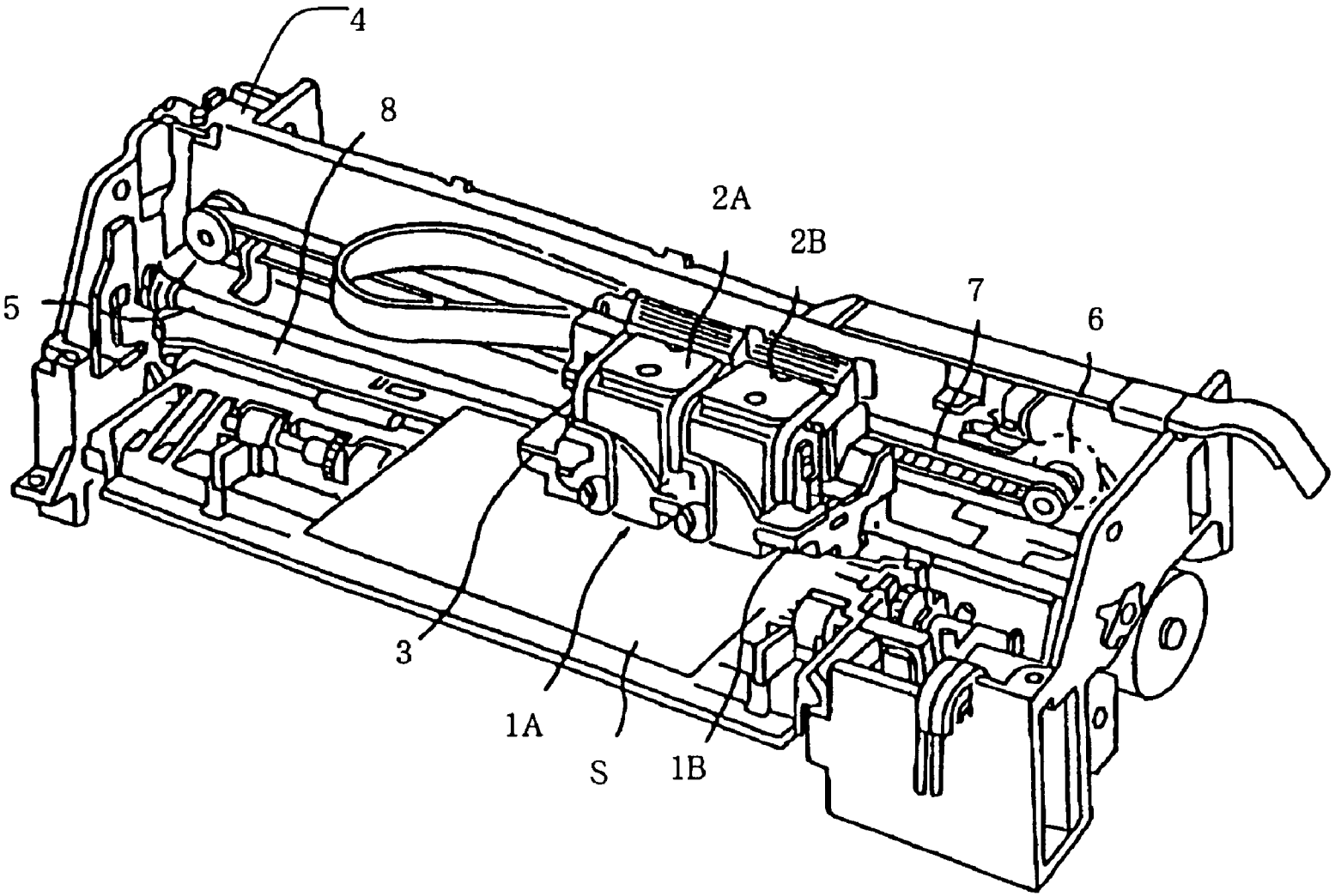
FIG. 12 is a schematic view showing a recording device according to one embodiment of the present invention.

Note that each of the ink-jet recording heads in the embodiments described above, constitutes a part of a recoding head unit which includes an ink flowing path for communicating with an ink cartridge and the like, and are installed in an ink-jet recording apparatus. FIG. 12 is a schematic view of an example of the ink-jet recording apparatus. As shown in FIG. 12, in a recording head unit 1A and a recording head unit 1B which include an ink-jet recording head, a cartridge 2A and a cartridge 2B which constitutes ink supply means are provided, in a way they are detachable. A carriage 3 having the recording head units 1A and 1B is provided on a carriage shaft 5 which is installed in a device body 4, in a way it is freely movable in an axial direction of a carriage shaft 5. The recording head units 1A and 1B are configured to eject, for example, a black-ink composition and a color-ink composition, respectively. There, a driving force generated in a driving motor 6 is transferred to the carriage 3 through a plurality of gears not illustrated and a timing belt 7, thereby the carriage 3 having the recording head units 1A and 1B is moved along the carriage shaft 5. On the other hand, in the device body 4, a platen 8 is provided along the carriage axis 5, and a recording sheet S is conveyed on the platen 8, which is fed by a feeding roller not illustrated, and which is a recording medium such as a sheet of paper.

Note that, in each of the above described embodiments, although the ink-jet recording head has been described as an example of liquid-jet heads of the present invention, basic configurations of the liquid-jet heads are not limited to the ones described above. The present invention is aimed broadly for liquid-jet heads in general, and obviously, the present invention is also applicable to other liquid-jet heads which inject liquid other than ink. As other liquid-jet heads, for example: various kinds of recording heads used in image recording apparatus such as a printer; a coloring material jet head used for producing color filters of liquid crystal displays and the like; an electrode material jet head used for forming electrodes for organic EL displays, FEDs (surface emitting displays) or the like; and a bio-organic material jet head used in producing bio-chips.

What is claimed is:

1. A liquid-jet head comprising:

a passage-forming substrate on which pressure generating chambers each communicating with a nozzle orifice are formed;

piezoelectric element which is provided on one surface of the passage-forming substrate with a vibration plate interposed therebetween, and includes a lower electrode, a piezoelectric layer and an upper electrode; and a laminated electrode which includes layers different from layers forming any one of the lower electrode and the upper electrode, is provided on the vibration plate outward of regions corresponding to the pressure generating chambers, and is electrically connected to the lower electrode, wherein a stress relaxing layer is provided at least in regions corresponding to edge portions of the laminated electrode between the laminated electrode and the vibration plate, the stress relaxing layer being formed of a material having a linear expansion coefficient greater than that of the vibration plate and less than that of the laminated electrode.

2. The liquid-jet head according to claim 1, wherein the stress relaxing layer is provided only in the regions corresponding to the edge portions of the laminated electrode.

3. The liquid-jet head according to claim 1, wherein the stress relaxing layer is provided so as to extend outward of a periphery of the laminated electrode.

4. The liquid-jet head according to claim 1, wherein the stress relaxing layer is formed of a ceramic material.

5. The liquid-jet head according to claim 4, wherein the stress relaxing layer is formed of the same layer as that of the piezoelectric layer constituting the piezoelectric element, and is separated from the piezoelectric layer constituting the piezoelectric elements.

6. The liquid-jet head according to claim 1, wherein a thickness of the stress relaxing layer is equal to or greater than that of the piezoelectric layer.

7. The liquid-jet head according to claim 1, wherein the passage-forming substrate is formed of a single crystal silicon substrate, and the vibration plate includes at least an elastic film formed of silicon dioxide formed on a surface of the passage-forming substrate.

8. A liquid-jet head comprising:

a passage-forming substrate on which pressure generating chambers respectively communicating with a nozzle orifice are provided, and a communicating portion communicating with each of the pressure generating chambers through a supply path is provided;

a piezoelectric element which is provided on the passage-forming substrate with a vibration plate interposed therebetween, and is each formed of a lower electrode, a piezoelectric layer and an upper electrode; and a reservoir forming plate which is joined to a surface of the passage-forming substrate, facing the piezoelectric elements, and has a reservoir portion communicating with the communicating portion, wherein, in a region corresponding to the supply paths, at least in a part of the region on the vibration plate to which the reservoir forming plate is joined, a laminated electrode is provided, with a stress relaxing layer interposed therebetween, so as to extend along the direction in which the pressure generating chambers are provided in a line, the laminated electrode including layers different from those constituting any one of the lower and upper electrodes and being electrically connected to the lower electrode, and the stress relaxing layer being formed of a material having a linear expansion coefficient greater than that of the vibration plate and less than that of the laminated electrode; and wherein, in a region facing the communication portion on the part of the laminated electrode, a discontinuous laminated electrode discontinuous from the laminated electrode is provided parallel to the laminated electrode, the stress relaxing layer, extending from a region corresponding to the laminated electrode, interposed therebetween.

9. The liquid-jet head according to claim 8, wherein the supply path is provided in a manner penetrating the passage-forming substrate.

10. The liquid-jet head according to claim 8, wherein the laminated electrode and the discontinuous laminated electrode are insulated from each other.

11. The liquid-jet head according to claim 8, wherein the stress relaxing layer is formed of a ceramic material.

12. The liquid-jet head according to claim 8, wherein the stress relaxing layer is formed of the same layer as the piezoelectric layer constituting the piezoelectric elements, and is separated from the piezoelectric layer constituting the piezoelectric elements.

13. The liquid-jet head according to claim 8, wherein a thickness of the stress relaxing layer is equal to or greater than that of the piezoelectric layer.

14. The liquid-jet head according to claim 8, wherein the reservoir forming plate includes a piezoelectric element holding portions protecting the respective piezoelectric elements.

15. The liquid-jet head according to claim 8, wherein the passage-forming substrate is formed of a single crystal silicon substrate, and the vibration plate includes at least an elastic film formed of silicon dioxide formed on a surface of the passage-forming substrate.

16. A liquid-jet apparatus comprising a liquid-jet head according to claim 1.

17. A liquid-jet apparatus comprising a liquid-jet head according to claim 2.

18. A liquid-jet apparatus comprising a liquid-jet head according to claim 3.

19. A liquid-jet apparatus comprising a liquid-jet head according to claim 4.

20. A liquid-jet apparatus comprising a liquid-jet head according to claim 5.

21. A liquid-jet apparatus comprising a liquid-jet head according to claim 6.

22. A liquid-jet apparatus comprising a liquid-jet head according to claim 7.

23. A liquid-jet apparatus comprising a liquid-jet head according to claim 8.

24. A liquid-jet apparatus comprising a liquid-jet head according to claim 9.

25. A liquid-jet apparatus comprising a liquid-jet head according to claim 10.

26. A liquid-jet apparatus comprising a liquid-jet head according to claim 11.

27. A liquid-jet apparatus comprising a liquid-jet head according to claim 12.

28. A liquid-jet apparatus comprising a liquid-jet head according to claim 13.

29. A liquid-jet apparatus comprising a liquid-jet head according to claim 14.

30. A liquid-jet apparatus comprising a liquid-jet head according to claim 15.

* * * * *